US008070166B2

(12) United States Patent
Nathanson

(10) Patent No.: US 8,070,166 B2
(45) **Date of Patent: *Dec. 6, 2011**

(54) GAME PIECE STORING AND SCORING PRODUCT

(75) Inventor: Abraham Nathanson, Cranston, RI (US)

(73) Assignee: Bananagrams Inc., Cranston, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/027,358

(22) Filed: Feb. 15, 2011

(65) Prior Publication Data

US 2011/0221128 A1 Sep. 15, 2011

Related U.S. Application Data

(63) Continuation of application No. 12/722,700, filed on Mar. 12, 2010, now Pat. No. 7,891,665.

(51) Int. Cl.
*A63F 9/00* (2006.01)

(52) U.S. Cl. ..... 273/287; 273/148 R; 273/309; 273/148 A; 273/272; 273/145 R; 273/145 C; 273/144 A; 273/286; 206/315.1; 206/579; D21/343; D10/46.1

(58) Field of Classification Search ..... 273/287, 273/148 R, 309, 272, 145 R, 145 C, 144 A, 273/286, 148 A; 206/315.1, 579; 235/90; D21/343; D10/46.1
See application file for complete search history.

(56) References Cited

U.S. PATENT DOCUMENTS

| | | | |
|---|---|---|---|
| 1,659,588 | A | 2/1928 | Balmforth |
| 2,544,900 | A | 3/1951 | Saqui |
| 2,667,353 | A | 1/1954 | Lanice |
| 4,842,133 | A | 6/1989 | LaBarge et al. |
| 5,114,146 | A | 5/1992 | Booker |
| 5,491,324 | A | 2/1996 | Vanderpool |
| 6,041,934 | A | 3/2000 | Alexson |
| 7,040,623 | B2 | 5/2006 | Poffenberger |
| 7,637,377 | B1 | 12/2009 | Peckholdt, Jr. |
| 2005/0230914 | A1 | 10/2005 | Campbell |
| 2009/0066024 | A1 | 3/2009 | Dotson |

*Primary Examiner* — Benjamin Layno
(74) *Attorney, Agent, or Firm* — Salter & Michaelson

(57) ABSTRACT

A score-keeping product for an anagram game that has a pouch for storing a plurality of anagram game cubes therein; a pair of slide members that each can be linearly moved between open and closed positions with each slide member, in an at least partially open position, enabling access to the interior of pouch so that the anagram game cubes can be stored or removed therefrom for the purpose of playing the game cubes with each of the slide members including a scoring pointer; and a pair of scoring indicia on the pouch and each disposed along a linear locus that extends respectively along side of a corresponding slide member with each scoring indicia provided with a series of score markers. The slide members are selectively movable so that the corresponding scoring pointer can be progressively moved to align with one of the series of score markers in scoring the game.

20 Claims, 5 Drawing Sheets

GAME PIECE STORING AND SCORING PRODUCT

This application is a continuation of U.S. patent application Ser. No. 12/722,700 filed Mar. 12, 2010, now U.S. Pat. No. 7,891,665.

FIELD OF THE INVENTION

The present invention relates in general to an apparatus that is used for storing game pieces while also facilitating scoring of the game played by the game pieces. More particularly, the present invention relates to a pouch used for, not only storing game pieces, but also usable for score keeping particularly for an anagram game.

BACKGROUND OF THE INVENTION

A pouch or the like container has been used for the storage of game pieces. For example, reference may be made to the Campbell U.S. Publication No. 2005/0230914 or to the Nathanson Design Pat. No. U.S. D551,451. Other prior art exists relating to score keeping. In this regard reference may be made to U.S. Pat. No. 5,491,324 to Vanderpool; U.S. Pat. No. 7,040,623 to Poffenberger and U.S. Pat. No. 2,544,900 to Saqui.

However, nothing presently exists in the prior art in which a pouch or the like can be used, not only for the storage of game pieces, but also as a means for score keeping.

Accordingly, it is an object of the present invention to provide a game piece storing and scoring apparatus.

Another object of the present invention is to provide a game piece storing and scoring apparatus in the form of a pouch or the like that, when at least partially open, enables access to the pouch so that the game pieces can be stored therein or removed therefrom for the purpose of playing the game pieces.

Still another object of the present invention is to provide a score keeping product for an anagram game that includes a pouch for storing a plurality of anagram game cubes that can be either stored or removed from the pouch for the purpose of playing the game cubes.

SUMMARY OF THE INVENTION

To accomplish the foregoing and other objects, features and advantages of the present invention there is provided a game piece storing and scoring apparatus comprising: a pouch for storing a plurality of game pieces therein; a pair of slide members that each can be linearly moved between open and closed positions with each slide member, in an at least partially open position, enabling access to the interior of pouch so that the game pieces can be stored or removed therefrom for the purpose of playing the game pieces; each of the slide members including a scoring pointer; and a pair of scoring indicia on the pouch and each disposed along a linear locus that extends respectively along side of a corresponding slide member. Each scoring indicia is provided with a series of score markers with the slide members being selectively movable so that the corresponding scoring pointer can be progressively moved to align with one of the series of score markers in scoring the game.

In accordance with other aspects of the present invention each of the slide members may comprise a zipper having a pull tab forming the scoring pointer; the scoring pointer is preferably directed in a direction transverse to the linear locus; the scoring markers are preferably represented by separated indicia markers; the indicia markers may be numeric; the pouch preferably has elongated sides and the zippers are disposed adjacent to the elongated sides; the scoring markers of the respective pair of scoring indicia are preferably disposed adjacent to the zippers but remote from the elongated sides; and the pouch preferably has an end strap.

In accordance with the present invention there is provided a score-keeping product for an anagram game comprising: a pouch for storing a plurality of anagram game cubes therein; a pair of slide members that each can be linearly moved between open and closed positions with each slide member, in an at least partially open position, enabling access to the interior of pouch so that the anagram game cubes can be stored or removed therefrom for the purpose of playing the game cubes with each of the slide members including a scoring pointer; and a pair of scoring indicia on the pouch and each disposed along a linear locus that extends respectively along side of a corresponding slide member. Each scoring indicia is provided with a series of score markers; wherein the slide members are selectively movable so that the corresponding scoring pointer can be progressively moved to align with one of the series of score markers in scoring the game.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
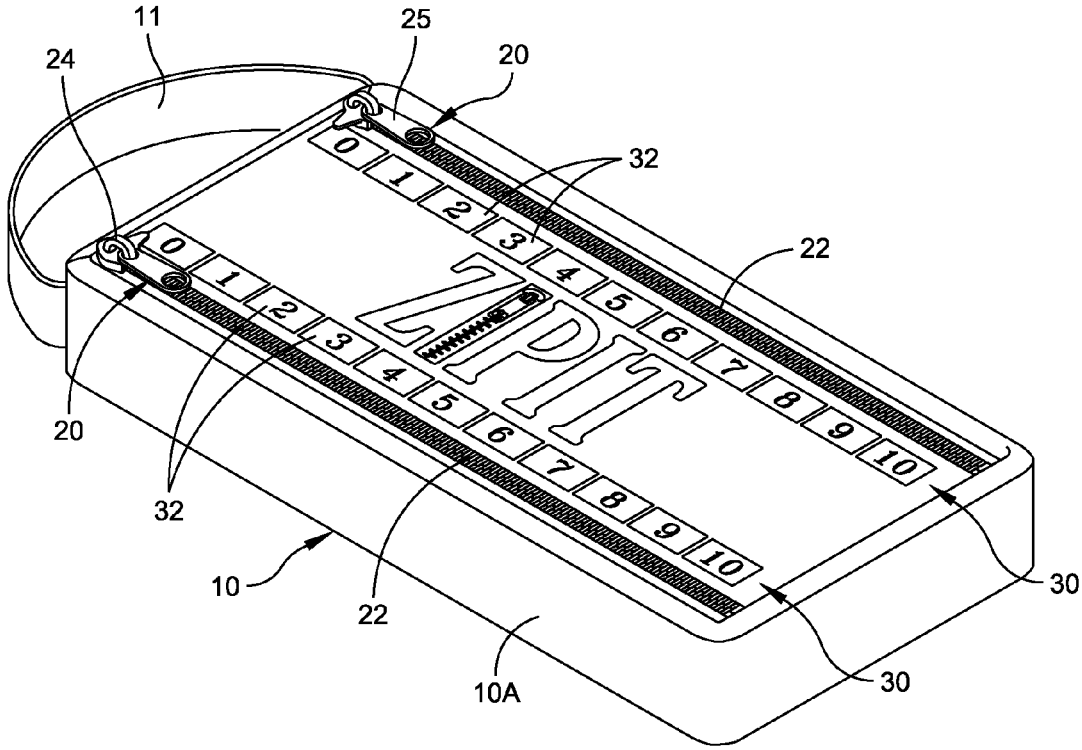
FIG. 1 is a perspective view of the pouch.
Figure 2:
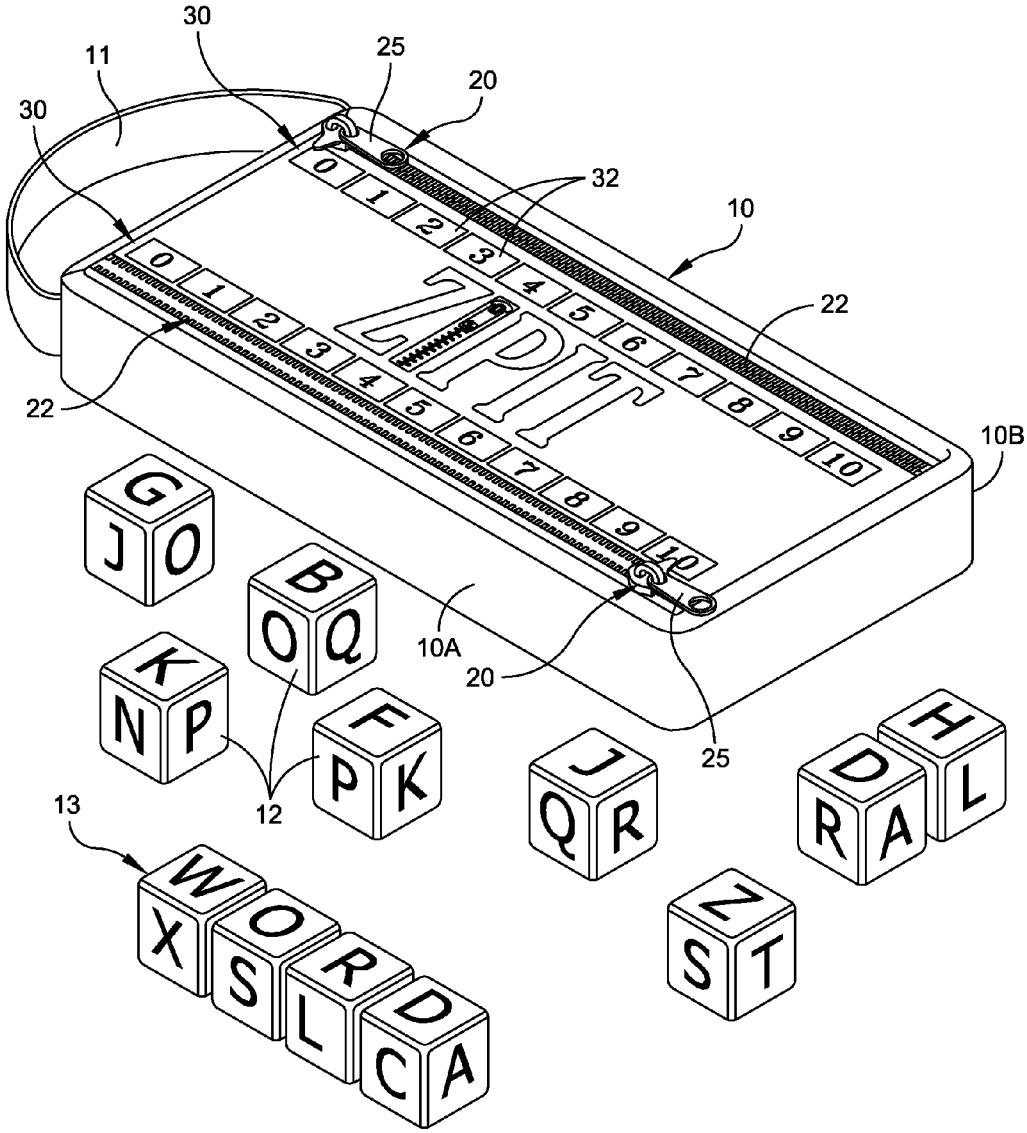
FIG. 2 is a perspective view of the pouch with one of the zippers opened and furthermore illustrating a series of game pieces.

Reference is now made to the drawings for one version of the product of the present invention. In the drawings there is shown a somewhat elongated pouch 10 that is used for the storage of game pieces 12 as shown in FIG. 2. In FIG. 1 the game pieces would be considered as already stored in the pouch 10.

The particular pouch illustrated in the drawings herein is used for the storage of game pieces for an anagram game. This game is typically played by only two players each of whom randomly pick a plurality of cubes from the pouch. It is typical to provide the game so that each player has 12 cubes. The first player to use up all of their cubes in a crossword fashion used in the anagram game is considered the winner of the game. Since in this embodiment of the game it frequently takes very little time for one of the players to use up all of his or her cubes and thus win the game, it has been found desirable to have a score keeping means for keeping a record of how many games each player wins. In accordance with the present invention, this objective is achieved by having a pouch that has opposed zippers that enable the pouch to be opened for access to the cubes positioned therein. The pouch is also provided with numbered markings along opposite edges so that each time a game is played, the winner can move his or her zipper one space to give the players a running score per player.

The pouch 10 can be constructed of a wide variety of different materials including a cloth material. At one end of the pouch 10 there may be provided a strap 11 to assist in carrying the pouch. The pouch 10 is also considered as including longitudinal extending sides 10A and 10B such as depicted in the plan view of FIG. 3.

Figure 3:
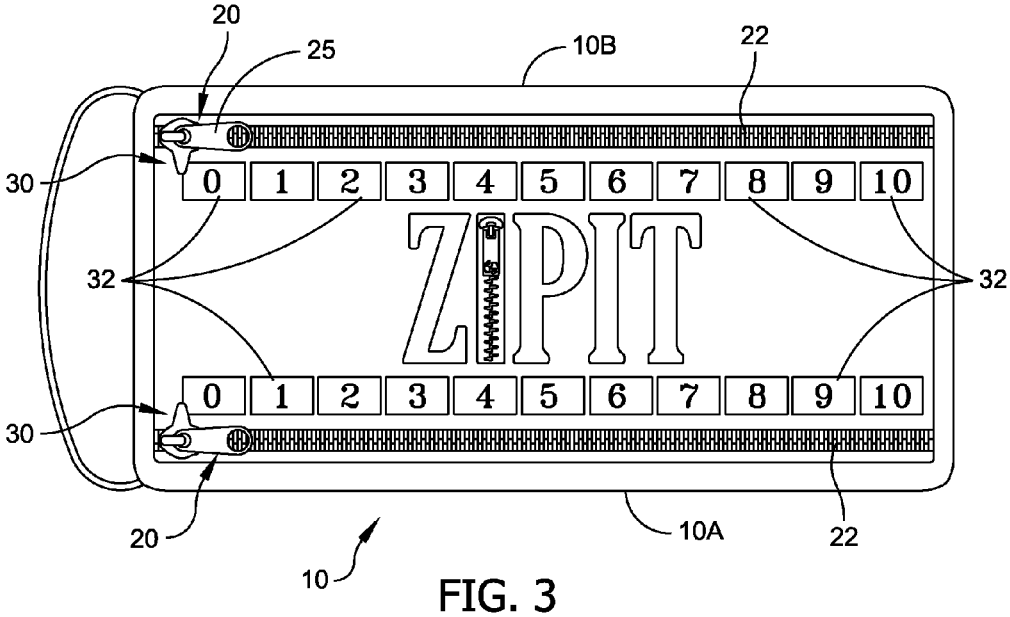
FIG. 3 is a top plan view of the pouch with both of the zippers fully closed and with the scoring pointer at the number "0"
Figure 6:
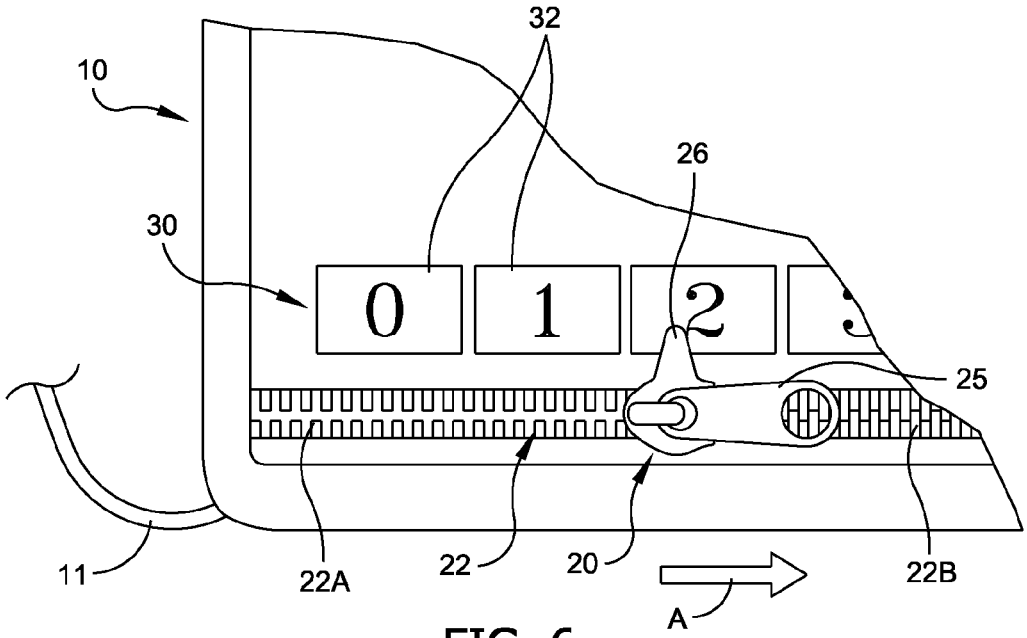
FIG. 6 is an enlarged plan view of a portion of the pouch illustrating scoring at the number "2"

In order to provide access to the game pieces that are stored within the pouch 10, one could normally provide a single zipper such as shown in U.S. Design Pat. No. D551,451. However, because the zipper arrangements of the present invention provide essentially a dual function use, of, not only providing access, but of also scoring, a pair of zippers or slide members 20 are provided as illustrated in FIGS. 1-3. These slide members 20 are illustrated in the disclosed embodiment as adjacent to the opposed longitudinal side walls. However, these slide members could also be provided at other positions on the pouch. It is preferred that the slide members and associated scoring indicia be on the same surface so that each player can see the scoring of not only himself or herself but also of the opposing player. In FIG. 1 the slide members are shown in a closed position while in FIG. 2 one of the slide members is shown as closed while the other is shown as in an open position. In FIG. 3 both of the slide members are shown in a closed position. The slide members can be linearly moved between open and closed position with each slide member, in an at least partially open position, enabling access to the interior of the pouch so that the game pieces can be stored or removed therefrom for the purpose of playing the game pieces. Again, FIG. 1 may be considered as a stored position for the game pieces while FIG. 2 may be considered as a position wherein the game pieces have been removed for playing the game. At 13 in FIG. 2, there is shown formation of a word by the game pieces 12. In the version of the present invention disclosed in the drawings, each of the slide members is in the form of a conventional zipper structure. However, the present invention should not be limited to the necessity of using a zipper as a slide member. Other forms of slide structures may also be employed as long as there is associated therewith a scoring pointer such as illustrated in FIG. 6, and as long as at least one of the slide members can be used for opening and closing the pouch.

Figure 4:
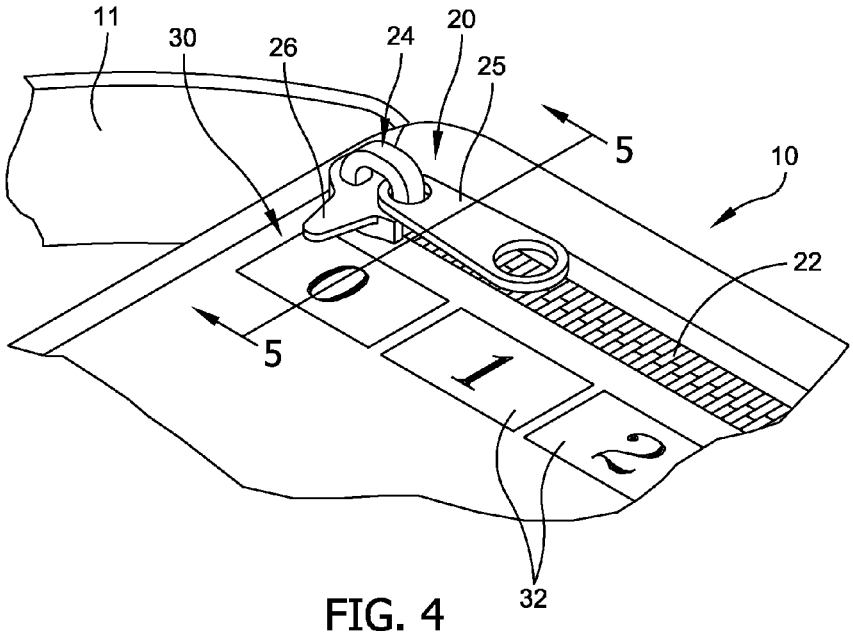
FIG. 4 is an enlarged fragmentary perspective view at the zipper slider.
Figure 5:
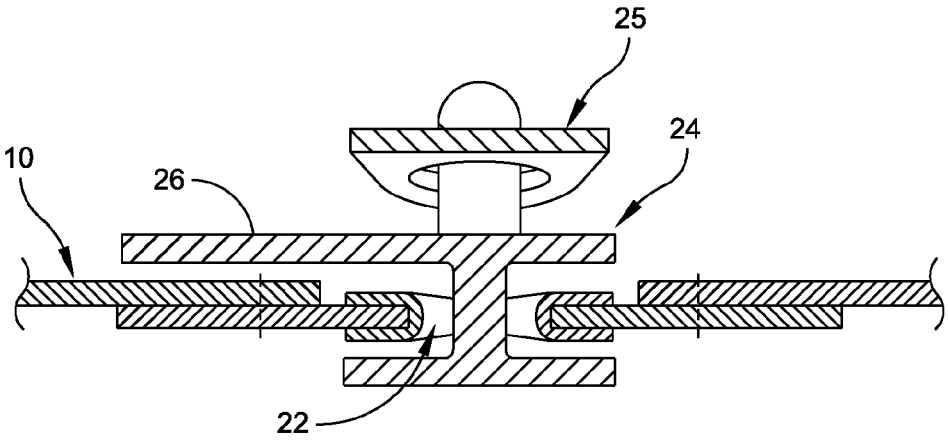
FIG. 5 is a cross-sectional view taken along line 5-5 of FIG. 4.

Now, and with reference to the enlarged fragmentary perspective view of FIG. 4, it is noted that the zipper is shown at 20 and includes the typical series of teeth 22 that are opened or closed as controlled from the slider 24. Refer also to the cross-sectional view of FIG. 5 taken along line 5-5 of FIG. 4 that illustrates the slider 24 bridging across the teeth 22. The function of the zipper is well known and thus is not described in great detail as to its specific operation herein. The zipper 20 has its slider 24 controlled from the pull tab 25. In FIGS. 4 and 5 a U-shaped member is considered as part of the slider 24 and is used for attachment of the pull tab 25. The slider 24 also defines a scoring pointer 26 which may be considered as integrally formed with the slider and extending in a direction substantially transverse to the linear motion of the zipper such as in the direction of arrow A in FIG. 6. Thus, with the use of the zipper pointer, the zipper itself can be used to open and close an opening so as to either have the zipper open or close for access to the inside of the pouch. At the same time, once all of the game pieces have been removed, the zipper is used as a scoring means by virtue of moving the zipper slider along the zipper structure between different positions for the purpose of scoring a game being played with the game pieces. In this regard refer to the fragmentary plan view of FIG. 6 which shows the pointer 26 having been moved to point to one of the numbers of a series of numbers used for scoring.

As far as the scoring with the pouch of the present invention, there are provided a pair of scoring indicia indicated at 30 and each disposed along a linear longitudinal locus that extends respectively along side of a corresponding slide member. The locus along 30 is in essence parallel to the zipper structure as represented by the parallel placement of the zipper teeth 22. Each of the scoring indicia 30 is comprised of a series of score markers 32 disposed in sequence. These score markers are represented by the numbers "0" through "10". Although each of the scoring indicia 30 is shown inboard of the zippers, in another alternate embodiment, the indicia could also be disposed outboard of the zippers. The slide members or zippers are selectively moveable so that the corresponding scoring pointer 26 can be progressively moved to align with one of the series of score markers 32 in scoring the game. In this regard, for example, in the fragmentary perspective view of FIG. 4, the pointer 26 is directed at the initial score marker 32 bearing the designation "0". Also refer to FIG. 6 that shows the slide member moved to the right in the direction of arrow A. In this regard it is noted that at 22A the zipper is shown in an open position and at 22B the zipper is shown in its closed position. In this particular view, the pointer 26 has been moved so that it now indicated the number "2", meaning one of the players has now won two games.

In connection with the present invention it is to be noted that, although the term "pointer" has been used herein to designate a member that "points" to a particular indicia, it should be apparent to one skilled in the art that the pointer 26 can take on many different forms and does not necessarily have to include a member with a pointed piece as illustrated in the drawings herein. For example, the tab 25 itself may be considered at a member that can designate a scoring location. Alternatively, the slide member may be constructed with a bulge on one or both sides that functions as an indicator of position. It is the movement of the slider along the locus next to the indicia that locates the slider in a certain position for the purpose of scoring by virtue of the position thereof.

Figures 7, 7A, 7B:
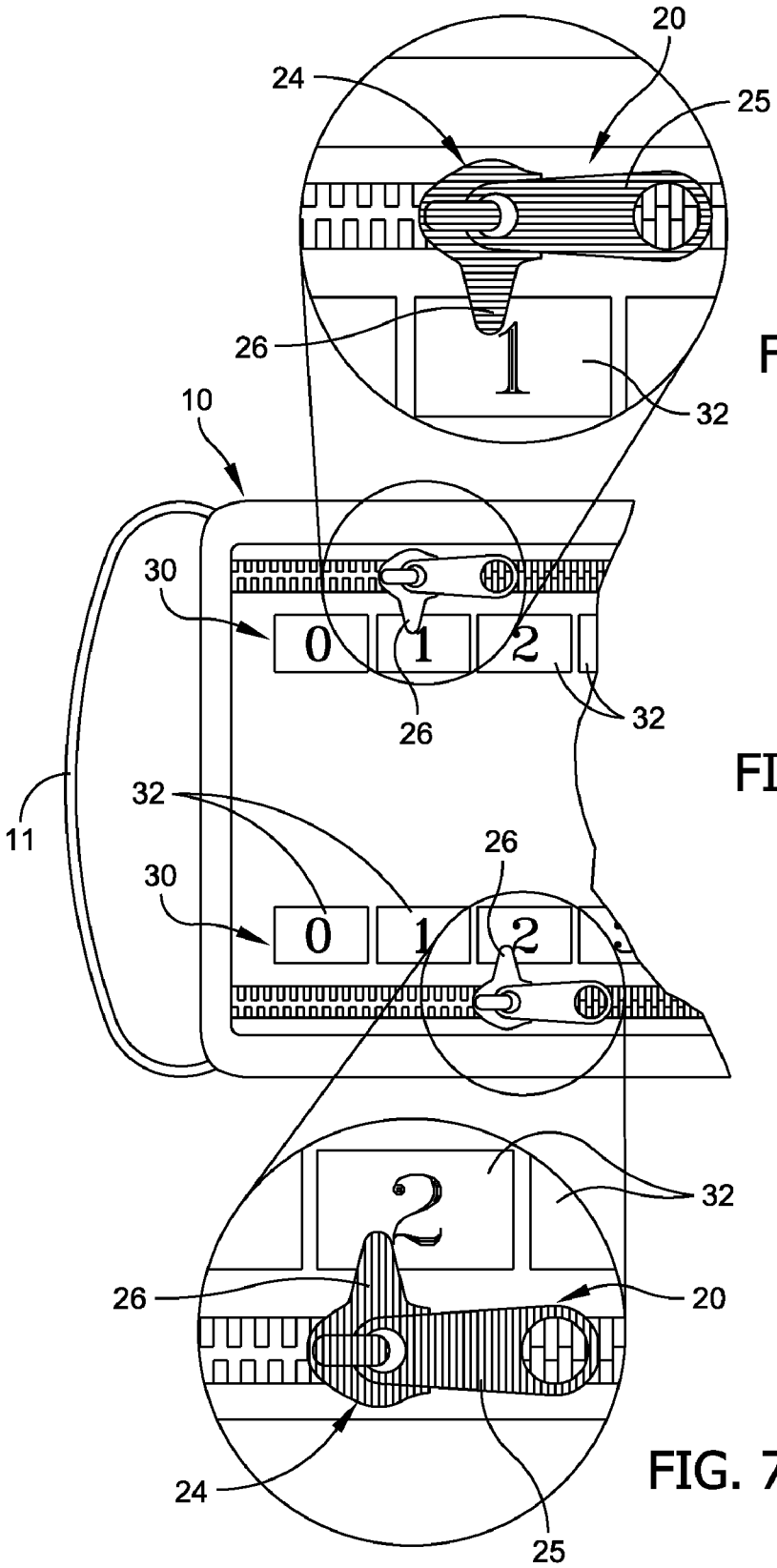
FIGS. 7, 7A and 7B represent different scorings by each of the separate players.

FIGS. 7, 7A and 7B illustrate different positions of the respective zippers so that in, for example, FIG. 7 the upper zipper is pointing to the number "1", while the lower zipper is pointing to the number "2". In this regard, at least the slider 24 itself may be formed of a different color. For example, one of the sliders for scoring on one side may be green while the slider on the other side may be colored red. As far as the scoring markers are concerned, this indicia may be provided on the outer surface of the pouch in a number of different ways such as by silk screening the numbers on the outer surface of the pouch. It is noted that each of these numbers preferably has a space therebetween. The winner of the overall game would be the one considered as having won ten games.

Having now described one specific embodiment of the present invention, it should now be apparent to those skilled in the art that numerous variations can be anticipated all falling within the scope of the present invention. For example, the pouch itself can be constructed of a number of different materials and can also be constructed in different forms and shapes. The slide member need not be a zipper, although the zipper is the preferred embodiment. In essence, any member that slides to open and close an opening while at the same time providing a pointer to point to certain indicia, would be considered as falling within the scope of the present invention. The relative placement between the indicia and the slide member can be in a number of different forms. The indicia has been shown as numbers, however, the indicia could also be of another type including symbols, diagrams or icons.

What is claimed is:

1. A game piece storing and scoring apparatus comprising:

a pouch for storing a plurality of game pieces therein;

at least one slide member that can be linearly moved between open and closed positions with the slide member, in an at least partially open position, enabling access to the interior of pouch so that the game pieces can be stored or removed therefrom for the purpose of playing the game pieces;

said at least one slide member including a scoring pointer;

at least one scoring indicia on the pouch and disposed along a linear locus that extends respectively along side of a corresponding slide member;

said scoring indicia provided with a series of score markers;

wherein the slide member is selectively movable so that the corresponding scoring pointer can be progressively moved to align with one of the series of score markers in scoring the game.

2. The apparatus of claim 1 wherein the slide member comprises a zipper having a pull tab forming the scoring pointer.

3. The apparatus of claim 2 wherein the scoring pointer is directed in a direction transverse to the linear locus.

4. The apparatus of claim 3 wherein the scoring markers are represented by separated indicia markers.

5. The apparatus of claim 4 wherein the indicia markers are numeric.

6. The apparatus of claim 5 wherein the pouch has elongated sides and the zipper is disposed adjacent to the elongated sides.

7. The apparatus of claim 6 wherein the scoring markers are disposed adjacent to the zipper but remote from the elongated sides.

8. The apparatus of claim 7 wherein the pouch has an end strap.

9. The apparatus of claim 1 including a pair of slide members and a pair of corresponding scoring indicia, and wherein the scoring markers are represented by separated indicia markers.

10. The apparatus of claim 9 wherein the indicia markers are numeric.

11. The apparatus of claim 9 wherein the pouch has elongated sides and the slide members are disposed adjacent to the elongated sides.

12. The apparatus of claim 11 wherein the scoring markers of the respective pair of scoring indicia are disposed adjacent to the slide members but remote from the elongated sides.

13. The apparatus of claim 1 wherein the pouch has an end strap.

14. A score-keeping product for an anagram game comprising:

a pouch for storing a plurality of anagram game cubes therein;

at least one slide member that can be linearly moved between open and closed positions with the slide member, in an at least partially open position, enabling access to the interior of pouch so that the anagram game cubes can be stored or removed therefrom for the purpose of playing the game cubes;

said at least one slide member including a scoring piece;

at least one scoring indicia on the pouch and disposed along a linear locus that extends respectively along side of a corresponding slide member;

said scoring indicia provided with a series of score markers;

wherein the slide member is selectively movable so that the corresponding scoring piece can be progressively moved to align with one of the series of score markers in scoring the game.

15. The apparatus of claim 14 wherein the scoring piece is a scoring pointer and the slide member comprises a zipper having a pull tab forming the scoring pointer.

16. The apparatus of claim 15 wherein the scoring pointer is directed in a direction transverse to the linear locus.

17. The apparatus of claim 14 including a pair of slide members and a pair of corresponding scoring indicia, and wherein the scoring markers are represented by separated indicia markers.

18. The apparatus of claim 17 wherein the indicia markers are numeric.

19. The apparatus of claim 17 wherein the pouch has elongated sides and the slide members are disposed adjacent to the elongated sides.

20. The apparatus of claim 19 wherein the scoring markers of the respective pair of scoring indicia are disposed adjacent to the slide members but remote from the elongated sides.

* * * * *